US010046383B2

(12) United States Patent
Yoshida et al.

(10) Patent No.: US 10,046,383 B2
(45) Date of Patent: Aug. 14, 2018

(54) CU—SN COEXISTING STEEL AND METHOD FOR MANUFACTURING THE SAME

(71) Applicant: NIPPON STEEL & SUMITOMO METAL CORPORATION, Tokyo (JP)

(72) Inventors: Naotsugu Yoshida, Kimitsu (JP); Hirofumi Nakamura, Kimitsu (JP); Takayuki Kamimura, Takarazuka (JP); Nobuo Otsuka, Nishinomiya (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 176 days.

(21) Appl. No.: 14/911,080

(22) PCT Filed: Aug. 26, 2014

(86) PCT No.: PCT/JP2014/072287
§ 371 (c)(1),
(2) Date: Feb. 9, 2016

(87) PCT Pub. No.: WO2015/029994
PCT Pub. Date: Mar. 5, 2015

(65) Prior Publication Data

US 2016/0201171 A1 Jul. 14, 2016

(30) Foreign Application Priority Data

Aug. 29, 2013 (JP) ..... 2013-177426

(51) Int. Cl.
*C22C 38/16* (2006.01)
*C22C 38/08* (2006.01)
(Continued)

(52) U.S. Cl.
CPC ..... *B22D 11/00* (2013.01); *B22D 11/001* (2013.01); *C21D 9/0081* (2013.01); *C22C 38/00* (2013.01);
(Continued)

(58) Field of Classification Search
None
See application file for complete search history.

(56) References Cited

U.S. PATENT DOCUMENTS 3,684,493 A * 8/1972 Hiroyuki Kubota et al. ..... C22C 38/42 420/91

FOREIGN PATENT DOCUMENTS

| | | |
|---|---|---|
| EP | 2 484 790 | 8/2012 |
| JP | 6-256904 | 9/1994 |

(Continued)

OTHER PUBLICATIONS

Machine-English translation of JP2000-054066, Yamamoto Koichi et al, dated Feb. 22, 2000.*

(Continued)

*Primary Examiner* — Deborah Yee
(74) *Attorney, Agent, or Firm* — Clark & Brody

(57) ABSTRACT

A method for manufacturing Cu—Sn coexisting steel produces a good quality surface even after hot rolling. The steel is manufactured by continuous casting a molten steel that contains C: 0.04 to 0.20%, Si: 0.05 to 1.00%, Mn: 0.20 to 2.50%, P: no more than 0.05%, S: no more than 0.02%, Cu: 0.20 to 1.50%, Sn: 0.06 to 0.50%, Al: 0.06 to 1.00% and Ni: 0.05 to 1.00% by mass, and Fe and impurities as the remainder. The composition of the molten steel is defined as [Al]/(3[Si]+[Mn])≥0.050, [Ni]/([Cu]+5[Sn])≥0.10 and [Al]/[Ni]≥0.20 if the content of an element X in the molten steel is represented as [X], an internal oxidation layer is formed in a process of cooling a slab, and $Al_2O_3$ is contained by the internal oxidation layer.

12 Claims, 3 Drawing Sheets

(51) Int. Cl.

| | |
|---|---|
| ***C22C 38/02*** | (2006.01) |
| ***C22C 38/06*** | (2006.01) |
| ***B22D 11/00*** | (2006.01) |
| ***C22C 38/00*** | (2006.01) |
| ***C22C 38/04*** | (2006.01) |
| ***C21D 9/00*** | (2006.01) |

(52) U.S. Cl.
CPC ..... *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/16* (2013.01); *C21D 9/00* (2013.01); *C21D 2211/004* (2013.01)

(56) References Cited

FOREIGN PATENT DOCUMENTS

| | | |
|---|---|---|
| JP | 2001-172753 | 6/2001 |
| JP | 2004-360063 | 12/2004 |
| JP | 2007-270198 | 10/2007 |
| JP | 2011-042859 | 3/2011 |
| JP | 2014-001445 | 1/2014 |

OTHER PUBLICATIONS

Kunishige, Kazutoshi et al., "Suppression of Surface . . . Cu and/or Sn", Current Advances in Materials and Processes, the Iron and Steel Institute of Japan, vol. 13, No. 6, pp. 1080-1083, 2000, and a concise explanation.

Bryan A. Webler et al., "Effects of 0.1 wt.% . . .wt.% Nickel Alloy", Oxidation of Metals, Kluwer Academic Publishers-Plenum Publishers, NE, vol. 71, No. 1-2, pp. 21-42, Nov. 19, 2008, XP019685982.

* cited by examiner

CU—SN COEXISTING STEEL AND METHOD FOR MANUFACTURING THE SAME

TECHNICAL FIELD

The present invention relates to low-alloy steel (Cu—Sn coexisting steel) for anticorrosive heavy gauge steel plate which contains Cu and Sn, and methods for manufacturing the same. Particularly, the present invention relates to steel without surface cracking or surface defects where neither surface cracking nor surface defects occur even if rolled to be heavy gauge steel plate, and a method for manufacturing the same.

BACKGROUND ART

Cu and Sn are both tramp elements in scrap iron. They are useful because they are elements improving the corrosion resistance of steel. However, it is known that Cu causes what is called red embrittlement, which causes cracking to occur in hot working on steel (hereinafter red embrittlement induced by Cu is also referred to as "Cu embrittlement"), and Sn encourages Cu embrittlement. Thus, when a steel material containing both Cu and Sn is manufactured, the ultimate object is to inhibit surface cracking and surface defects.

Patent Literature 1 discloses a steel material having outstanding weatherability on sea shores which contains both Cu and Sn, and a structure using the same. However, this literature does not focus on prevention of surface embrittlement of a slab at hot temperature and of surface defects in continuous casting.

Patent Literature 2 discloses hot-rolled steel containing both Cu and Sn for the manufacture without occurrence of surface defects in hot working. This literature also describes that although addition of Ni to steel containing Cu makes it possible to prevent cracking on the surface of the steel which is induced by Cu, the effect of preventing cracking that Ni has diminishes on steel containing Sn in addition to Cu. However, according to this literature, Ni is considered to be a little as resources and invite high costs, and an object is to provide hot-rolled steel of a good surface property without addition of Ni. There is no enough description of the effect when Ni coexists with Cu and Sn.

Patent Literature 3 discloses the art an object of which is to prevent surface defects from occurring through continuous casting with the ratios of the components, Cu/Sn and (Cu+Ni)/Sn of anticorrosive low-alloy steel of predetermined ranges.

Each steel of Patent Literatures 2 and 3 is low-alloy steel whose content of Sn is more than twice that of Cu. The upper limit of the value of the ratio of the components, Cu/Sn (% by mass) (hereinafter referred to as "Cu/Sn ratio") of the steel of these Literatures is 0.5. If the Cu/Sn ratio is too high, surface cracking occurs. Thus, it is difficult to improve the Cu/Sn ratio for the purpose of improvement of a property like corrosion resistance.

Non Patent Literature 1 lists the following a and b as the influences of Cu and Sn on cracking in hot working due to red shortness (liquid embrittlement) on the surface:

a. Scales are generated on the surface of a steel material heated to 1000° C. or more because of atmospheric oxidation. In a case of steel whose content of Cu is approximately 0.3% by mass, Fe that is the main component of the parent phase is selectively oxidized, and Cu is concentrated on the surface portion of the steel material. At this time, Cu, which has a lower melting point than Fe, is separated on the surface portion of the steel metal as a liquid phase. This penetrates grain boundaries, to invite liquid membrane embrittlement.

b. Cu, Sn and Ni are all metallic elements that are more difficult to be oxidized than Fe that is the main component of the parent phase, that is, nobler than Fe. Surface cracking on a steel material is conspicuous in a case of steel containing Cu and Sn among the above elements (Cu: 0.3% by mass and Sn: 0.04% by mass) compared with steel containing only Cu among the above elements (Cu: 0.3% by mass). There occurs no surface cracking in a case of steel containing only Sn among the above elements (Sn: 0.04% by mass).

In Non Patent Literature 1, the effect of inhibiting embrittlement induced by Cu and Sn that Ni has is also examined. According to this literature, it is enough for inhibiting embrittlement of the above described steel containing only Cu to add Ni of 0.15% by mass; on the other hand, it is necessary for inhibiting embrittlement of the above described steel containing Cu and Sn to add Ni of 0.3% by mass.

As described above, Non Patent Literature 1 merely describes that Sn and Ni affect inhibition of embrittlement of the above described steel containing only Cu, and that there occurs no embrittlement to the above described steel containing only Sn.

CITATION LIST

Patent Literature

Patent Literature 1: JP 2004-360063 A
Patent Literature 2: JP H6-256904 A
Patent Literature 3: JP 2011-42859 A

Non Patent Literature

Non Patent Literature 1: KUNISHIGE, Kazutoshi and other three, "Suppression of Surface Hot-shortness Induced by Cu and/or Sn", *Current Advances in Materials and Processes*, the Iron and Steel Institute of Japan, Vol. 13, No. 6, pp. 1080-1083, 2000

SUMMARY OF INVENTION

Technical Problem

The present invention is in view of these problems, that is, occurrence of surface cracking and surface defects caused by Cu embrittlement when steel containing Cu and Sn is manufactured. An object of the present invention is to provide Cu—Sn coexisting steel that makes it possible to keep a good quality of its surface even if hot-rolled, and a method for manufacturing the same.

Solution to Problem

The inventors of the present invention select low-alloy steel containing Cu and Sn which can be a material of heavy gauge steel plate of a good corrosion resistance in order to solve the problems. Specifically, selected is Cu—Sn coexisting steel containing C: 0.04 to 0.20%, Si: 0.05 to 1.00%, Mn: 0.20 to 2.50%, Cu: 0.20 to 1.50% and Sn: 0.06 to 0.50% by mass. This composition makes it possible to obtain a good corrosion resistance while satisfying mechanical characteristics as a material of heavy gauge steel plate. It is preferable that the Cu/Sn ratio (mass ratio) in this steel satisfies 1.0 to 8.0 in order to improve the corrosion resistance. However, Cu embrittlement is easy to occur conspicuously to this steel because Cu and Sn coexist in this steel.

The inventors of the present invention examined composition that makes it possible to inhibit Cu embrittlement occurring to the above described Cu—Sn coexisting steel accompanied by selective oxidation of Fe. In this examination, influence of not only Cu and Sn but also coexisting alloying elements is focused on, and also, an internal oxidation layer that is formed when the surface of a slab is oxidized in the process of cooling the slab is focused on.

An internal oxidation layer is a preliminary oxidation layer generated by oxidation of alloying elements that are baser than Fe at a step before Fe of the parent phase is oxidized. In the above Cu—Sn coexisting steel, the internal oxidation layer is a layer where minute oxides composed of Si and Mn (the main components are $SiO_2$, MnO and SiMnO (manganese silicate)) are dispersed. The content of $Al_2O_3$ in oxides in this internal oxidation layer is less than 3% by mass at most so far.

As a result of the examination, it is found out that occurrence of surface cracking accompanied by Cu embrittlement can be inhibited by: adding Al and Ni to the above Cu—Sn coexisting steel in a molten state, to adjust the composition of this molten steel so that the contents of Si, Mn, Cu, Sn, Al and Ni satisfy predetermined conditions; further oxidizing the surface of a slab in the process of cooling the slab to form the internal oxidation layer; and containing $Al_2O_3$ in composite oxides that are generated in this internal oxidation layer. Al and Ni are elements having a function of improving the solid solubility of Cu into steel. On the other hand, in a case where either Al or Ni is contained solely, no great effect is obtained on inhibition of occurrence of surface cracking. Examined details on conditions of adding Al and Ni will be described later.

The present invention is based on this finding. Its summary lies in the following method for manufacturing Cu—Sn coexisting steel and Cu—Sn coexisting steel manufactured by this manufacturing method.

A method for manufacturing Cu—Sn coexisting steel by continuous casting of molten steel, the method including: adjusting composition of molten steel so as to satisfy conditions represented by the following formulas (1) to (3), the molten steel containing, as chemical composition, C: 0.04 to 0.20%, Si: 0.05 to 1.00%, Mn: 0.20 to 2.50%, P: no more than 0.05%, S: no more than 0.02%, Cu: 0.20 to 1.50% and Sn: 0.06 to 0.50% and further contains Al: 0.06 to 1.00% and Ni: 0.05 to 1.00% by mass, and Fe and impurities as the remainder; forming an internal oxidation layer by oxidizing a surface of a slab in a process of cooling the slab; and making composite oxides that are generated in the internal oxidation layer, contain $Al_2O_3$:

$$[Al]/(3[Si]+[Mn])\geq 0.050 \quad (1)$$

$$[Ni]/([Cu]+5[Sn])\geq 0.10 \quad (2)$$

$$[Al]/[Ni]\geq 0.20 \quad (3)$$

wherein [Al], [Si], [Mn], [Ni], [Cu] and [Sn] represent contents (% by mass) of Al, Si, Mn, Ni, Cu and Sn in the molten steel respectively.

It is preferable that in the method for manufacturing Cu—Sn coexisting steel of the present invention, a content of $Al_2O_3$ in the composite oxides that are generated in the internal oxidation layer is 15 to 40% by mass. It is also preferable that the composition of the molten steel is adjusted so as to further satisfy a condition represented by the following formula (4), that is, the Cu/Sn ratio ranges from 1.0 to 8.0:

$$1.0\leq [Cu]/[Sn]\leq 8.0 \quad (4).$$

In the following description, "% by mass" concerning composition of the steel and composite oxides is also represented as "%" simply. "Steel material" in the following description shall include cast slabs and processed goods obtained by processing on slabs such as rolling.

"Al in an oxide" in the following description means Al as one constituent element of an oxide. Thus, in addition to Al in simple $Al_2O_3$, "Al in an oxide" also includes Al in a composite oxide, for example, Al in an oxide containing Al, Si and Mn.

"The content of $Al_2O_3$ in a composite oxide" in the present invention shall be the content of $Al_2O_3$ when a composite oxide is assumed to be composed of $Al_2O_3$, $SiO_2$ and MnO. Actual composite oxides include oxides of complex composition of a ternary or more system. It is difficult to calculate the content of $Al_2O_3$ in such a composite oxide. Here, the O content in a composite oxide depends on the stoichiometric ratio based on the content and a valence of each metallic element of Al, Si and Mn. Therefore, a composite oxide is assumed to be composed of $Al_2O_3$, $SiO_2$ and MnO, and the content of $Al_2O_3$ in this composite oxide shall be calculated. A specific calculation method will be described later.

Advantageous Effects of Invention

According to the method for manufacturing Cu—Sn coexisting steel of the present invention, slabs of a good quality where surface cracking and surface defects accompanied by Cu embrittlement are inhibited from occurring can be manufactured.

The Cu—Sn coexisting steel of the present invention has no surface cracking or surface defects, and surface cracking does not occur thereto even in hot-rolling that is a post process. Thus, a steel material of a good surface quality can be manufactured by means of the Cu—Sn coexisting steel of the present invention as a material.

DESCRIPTION OF EMBODIMENTS

Figure 1:
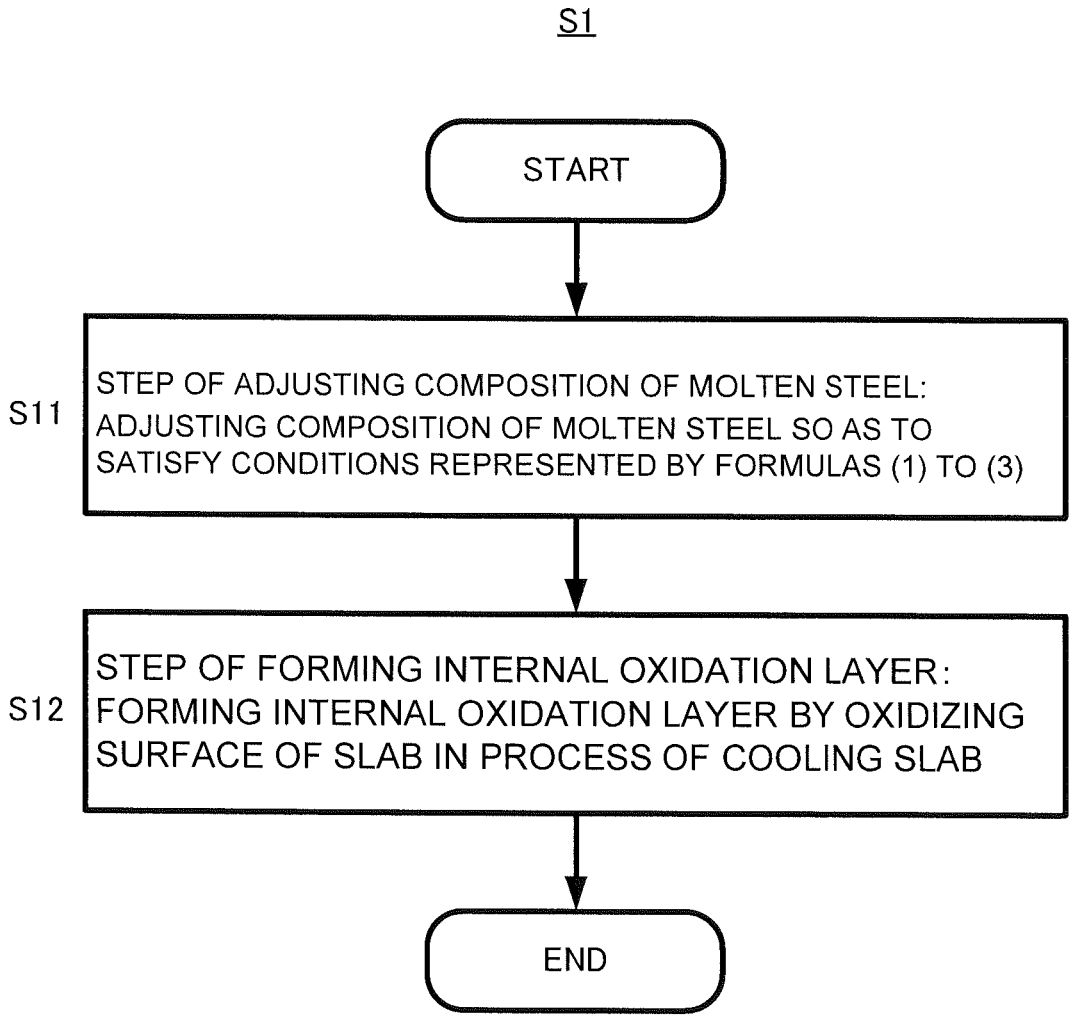
FIG. 1 is a flowchart to explain a method for manufacturing Cu—Sn coexisting steel according to one embodiment of the present invention.

Described below will be the examination done for completing the method for manufacturing Cu—Sn coexisting steel of the present invention, and the reasons why the composition of the steel is specified as described above. It is noted that as to ranges of numerical values, expression "A to B" means "no less than A and no more than B". If a unit is appended only to the numerical value B in such an expression, the unit is also applied to the numerical value A.

1. Examination for Completing Present Invention 1-1. Examination of Additional Elements Originally, it is considered that red embrittlement induced by Cu (Cu embrittlement) in steel containing Cu occurs because a Cu liquid phase penetrates grain boundaries of an austenite phase of Fe that is the parent phase, to weaken the grain boundaries. Separation of a Cu liquid phase is likely to occur at temperatures around 1100° C. (for example, in the temperature range about 1050 to 1150° C.).

The Cu liquid phase is generated because Cu that is nobler than Fe is locally concentrated when Fe that is the main component of the steel is selectively oxidized since the melting point of Cu is lower than Fe, and thus, the Cu concentration exceeds the solubility limit in the austenite phase of Fe that is the parent phase. That is, the solubility limit of Cu in Fe at high temperature is one of important factors for making Cu embrittlement appear.

It is necessary for inhibiting Cu embrittlement to inhibit separation and accumulation of the Cu liquid phase. Thus, it is considered that the solubility limit of Cu in Fe is enlarged by addition of alloying elements as a way for inhibiting red embrittlement.

Such alloying elements are so limited that are generally used for steel, coexist Cu, and enlarge the solubility limit of Cu in Fe. The inventors of the present invention examine various alloying elements on computational phase diagrams, and find out that only elements of Ni and Al are practically usable while added to steel.

1-2. Examination of Effects of Elements

Ni is an element nobler than Fe as well as Cu. Ni inhibits Cu embrittlement because Ne enlarges the solubility limit of Cu in Fe, to raise the melting point of Cu. Thus, in general, Ni is added to steel containing Cu, to prevent occurrence of cracking to a steel material.

Here, Sn that is made to coexist with Cu in the steel in the present invention is an element nobler than Fe as well as Cu. Sn encourages Cu embrittlement because Sn shrinks the solubility limit of Cu for Fe, to drop the melting point of Cu. Thus, when Cu and Sn coexist in the steel, the cracking susceptibility extremely increases, and therefore, it is difficult to completely prevent occurrence of cracking even if Ni is just added.

As a way of inhibiting Cu embrittlement, such a measure is considered as preventing a liquid phase of a low melting point from forming, that is, limiting the content of Sn. Addition of Sn lowers the melting point of Cu and encourages Cu embrittlement. Thus, it is difficult to manufacture slabs without occurrence of surface cracking while Cu and Sn are positively made to coexist in the steel.

On the other hand, Al is baser than Fe, which is different from Cu and Ni. Al has the function of improving the solubility limit of Cu for Fe. However, when steel is oxidized, Al is selectively oxidized prior to Fe. Because of this, it is generally considered that Al has no effect on Cu embrittlement.

Such phenomena relating to Cu embrittlement correspond to selective oxidation behavior of steel. That is, alloying elements that are baser than Fe are oxidized prior to the parent phase; next, Fe of the parent phase is oxidized; and alloying elements that are nobler than Fe are concentrated in the parent phase.

Cu embrittlement behavior in the Cu—Sn coexisting steel was examined, focusing on Ni and Al in selective oxidation. Used for the examination is: Cu—Sn coexisting steel of composition suitable for a structural material for heavy gauge steel plate, containing C: 0.04 to 0.20%, Si: 0.05 to 1.00%, Mn: 0.20 to 2.50%, Cu: 0.20 to 1.50% and Sn: 0.06 to 0.50%, and Fe and impurities as the remainder. This Cu—Sn coexisting steel is a material of an extremely high cracking susceptibility because its C content invites a high longitudinal cracking susceptibility, and in addition, Cu embrittlement is conspicuous therein due to the coexistence of Cu and Sn. The following findings are obtained as a result of the examination of the inventors of the present invention on this Cu—Sn coexisting steel.

1-2-1. Effects of Ni

In a case where Ni is added so that the Ni content is 0.1 to 0.5%, to make the Al content no more than 0.05% in the above Cu—Sn coexisting steel, the surface portion of the steel material is oxidized, to form scales. As to these scales, the following effects a to d arise.

a. The shapes of interfaces between scales and the parent phase of the surface portion of the steel material are roughened. This roughening of the interfaces has a function of inhibiting accumulation of a liquid phase on the interfaces, which is advantageous for removing the separated Cu liquid phase to the scales and inhibiting occurrence of Cu embrittlement.

b. The solubility limit of Cu in Fe is enlarged, and an amount of separation of the Cu liquid phase decreases. The melting point of the separated Cu liquid phase rises due to dissolution of Ni in Cu.

c. It is inhibited that oxidation of entire Fe of the parent phase of the surface portion of the steel material progresses. Ni is concentrated on the surface portion of the steel material, and an FeNi alloy phase is generated. When the Ni concentration in Fe increases on the surface portion of the steel material, it gets difficult that oxidation of Fe occurs because the solid solubility of O in Fe increases, and at the same time, it is inhibited to form the internal oxidation layer in the parent phase of the surface portion of the steel material.

d. The Cu liquid phase separated on the surface portion of the steel material and the FeNi alloy phase formed on the surface portion of the steel material inhibit oxidation of a part that is inside the alloy phase formed on the surface portion of the steel material, and also inhibit the growth of the internal oxidation layer. However, because the alloy phase on the surface portion of the steel material is not uniform in thickness, the internal oxidation layer in its inside is not uniform in thickness.

1-2-2. Effects of Al

In a case where Al is added so that the Al content is 0.1 to 0.5%, to make the Ni content less than 0.05% in the above Cu—Sn coexisting steel, the surface portion of the steel material is also oxidized, to form scales. The following effects e and f arise due to Al.

e. The solubility limit of Cu in Fe is enlarged. However, because Al is an element baser than Fe, Al is selectively oxidized prior to Fe, which is the main component of the parent phase when the steel material is oxidized. Thus, the effect of inhibiting separation of the Cu liquid phase of Al is smaller than that of Ni.

f. It is promoted to form the internal oxidation layer in the vicinity of the surface of the steel material due to the selective oxidation. In a usual steel material that does not contain Al, Si and Mn that are baser than Fe, which is the main component, are selectively oxidized early. Thus, on the surface portion of the steel material, oxides of Si and Mn are formed first, and composite oxide particles where Si and Mn are enriched disperse into the internal oxidation layer. Later, oxides (scales) of Fe are formed. On the other hand, Al is easier to be oxidized than Fe, as well as Mn and Si. Thus, in the steel material containing Al, it is promoted to form the internal oxidation layer accompanied by the selective oxidation. In addition, oxides where Si and Mn are enriched and oxides where Al is enriched are generated independently, and in the internal oxidation layer, oxide particles disperse more than in the usual steel material that does not contain Al. Oxide particles in the internal oxidation layer are so minute because they are separated from a solid phase since O in the steel material is increased by progress of oxidization of the surface to exceed the dissolution limit. In the early stage of a separation process, while minute particles of no more than 0.1 μm in diameter can exist, generally oxide particles of 0.2 μm or more in diameter can be easily observed with an optical microscope or an electron microscope. In the internal oxidation layer of 20 to 200 μm in thickness in the surface of the steel material, oxide particles approximately in the range of 0.2 to 1.0 μm in diameter are dispersed. The density of dispersion of observable oxide particles that are 0.2 μm or more in diameter is approximately 100,000 to 1,200,000 particles/$mm^2$.

1-2-3. Effects of Using Ni and Al Together

As described above, it is found out that while addition of Ni and Al affects selective oxidation behavior of Fe of the parent phase in the Cu—Sn coexisting steel, if one of Ni and Al is lacking, the effect of inhibiting Cu embrittlement accompanied by the Cu liquid phase is small.

The inventors of the present invention find out as a result of examination time after time that the following effects g to j can be obtained and Cu embrittlement can be inhibited by using Ni and Al together to have appropriate contents.

g. The shapes of interfaces between scales and the parent phase of the surface portion of the steel material are roughened.

h. The solubility limit of Cu in Fe is enlarged.

i. The internal oxidation layer of uniform thickness is formed inside the Cu liquid phase and the FeNi alloy phase that are on the surface portion of the steel material.

j. Oxide particles in the internal oxidation layer are likely to be generated inside the alloy phase that is on the surface of the steel material, and the Cu liquid phase is easy to be removed to scales.

Among these effects, g and h are due to the above described function of Ni. In addition to these effects, the effects of i and j are obtained by the use of Ni and Al together. According to these effects, Cu embrittlement can be inhibited and occurrence of the surface cracking can be prevented by having the appropriate contents of Ni and Al in the Cu—Sn coexisting steel. Roughening of interfaces between scales and the parent phase of the surface portion of the steel material is, for example, about 20 to 100 μm in depth (difference between a convex portion and a concave portion), and the interval of the roughening (interval between a convex portion and a concave portion that are adjacent to each other) is, for example, about 20 to 50 μm.

2. Composition of Cu—Sn Coexisting Steel of Present Invention and Reason why it is Limited The Cu—Sn coexisting steel of the present invention is based on the findings obtained from the results of the above examination. Its composition is C: 0.04 to 0.20%, Si: 0.05 to 1.00%, Mn: 0.20 to 2.50%, P: no more than 0.05%, S: no more than 0.02%, Cu: 0.20 to 1.50%, Sn: 0.06 to 0.50%, Al: 0.06 to 1.00% and Ni: 0.05 to 1.00%, and Fe and impurities as the remainder. Examples of impurities in the present invention include H, N, O, Mg, Ca, Sr, As, Se, Sb and Te. Part of Fe can be substituted with other alloy components. Examples of other alloy components in the present invention include B, Ti, Zr, V, Nb, Cr, Mo and W.

C: 0.04 to 0.20%

C is an element having the effect of improving the strength of materials. In order to obtain this effect, the C content shall be 0.04% or more. On the other hand, if the C content exceeds 0.20%, the toughness decreases and the welding cracking susceptibility increases. Thus, the C content shall be 0.04 to 0.20%.

Si: 0.05 to 1.00%

Si is an element effective for deoxidation. In order to obtain this effect, the Si content shall be 0.05% or more. On the other hand, if the Si content exceeds 1.00%, the toughness might decrease. Thus, the Si content shall be 0.05 to 1.00%.

Mn: 0.20 to 2.50%

Mn is an element having the effect of improving the strength of materials. In order to obtain this effect, the Mn content shall be 0.20% or more. On the other hand, if the Mn content exceeds 2.50%, the toughness might decrease. Thus, the Mn content shall be 0.20 to 2.50%.

P: no more than 0.05%

P is an impurity element inevitably included in a steel material. The less the better. If the P content exceeds 0.05%, the cracking susceptibility at hot temperature increases. Thus, the P content shall be no more than 0.05%, and the less the more preferable. The upper limit of P is preferably 0.03%.

S: no more than 0.02%

S is an impurity element inevitably included in a steel material. The less the better. If the S content exceeds 0.02%, the cracking susceptibility in hot working increases. Also, an amount of MnS inclusions that are the starting points of corrosion of the steel material increases, to break down the corrosion resistance. Thus, the S content shall be no more than 0.02%, and the less the more preferable. The upper limit of S is preferably 0.010%.

Cu: 0.20 to 1.50%

Cu is an element having the effect of improving the corrosion resistance of steel. In order to obtain this effect, the Cu content shall be 0.20% or more. On the other hand, if Cu in the steel material excessively exists, red embrittlement occurs in a step accompanied by high temperature oxidation at high temperature in a step of manufacturing the steel, for example, in a continuously casting step and a hot-rolling step, and cracking or defects is/are generated on the surface of the steel material. Thus, the Cu content shall be no more than 1.50%.

Sn: 0.06 to 0.50%

Sn is an element having the effect of improving the corrosion resistance of steel. In order to obtain this effect, the Sn content shall be 0.06% or more. On the other hand, if the Sn content exceeds 0.50%, the corrosion resistance does not improve any more. If Sn is contained by steel that contains Cu, the corrosion resistance improves but red embrittlement is encouraged, and surface defects are easy to occur in the manufacturing step. Thus, the Sn content shall be no more than 0.50%.

2-1. Reasons why Contents of Al and Ni are Limited

Al: 0.06 to 1.00%

Al is originally an element used for deoxidizing steel. In the present invention, Al is contained in order to inhibit Cu embrittlement. However, if the Al content is less than 0.06%, the effect of inhibiting embrittlement is not sufficiently obtained. In contrast, the Al content beyond 1.00% makes the content of $Al_2O_3$ that is generated in the internal oxidation layer formed in a step of cooling a slab excess, and the effect of inhibiting embrittlement is ruined. According to the above, in the present invention, the Al content shall be 0.06 to 1.00%. This Al content means the content of acid soluble Al.

Ni: 0.05 to 1.00%

Ni is an element of enlarging the solubility limit of Cu in Fe, roughening the interfaces between scales and the parent phase of the surface portion of a steel material and promoting the removal of the separated Cu liquid phase toward the scale side. In addition, Ni is an element of forming a FeNi alloy phase on the surface portion of a steel material, and suppressing the progress of oxidation of the parent phase. However, if the Ni content is less than 0.05%, the effect of inhibiting embrittlement is not sufficiently obtained. If the Ni content exceeds 1.00%, not only it is not economically preferable, but also it suppresses the growth of the internal oxidation layer in the alloy phase because Ni is easy to form the FeNi alloy phase when the surface portion of a steel material is selectively oxidized, to encourage the progress of oxidation of grain boundaries. According to the above, in the present invention, the Ni content shall be 0.05 to 1.00%.

2-2. Reasons why Ratios of Components are Specified. In the present invention, composition of molten steel is further adjusted so as to satisfy the relationship of the following formulas (1) to (3):

$$K1=[Al]/(3[Si]+[Mn])\geq 0.050 \quad (1)$$

$$K2=[Ni]/([Cu]+5[Sn])\geq 0.10 \quad (2)$$

$$K3=[Al]/[Ni]\geq 0.20 \quad (3)$$

where [Al], [Si], [Mn], [Ni], [Cu] and [Sn] are the contents (% by mass) of Al, Si, Mn, Ni, Cu and Sn in the molten steel, respectively.

It is preferable that the composition of the molten steel is adjusted so as to satisfy the relationship of the following formula (4):

$$1.0\leq [Cu]/[Sn]\leq 8.0 \quad (4)$$

These formulas are found out as a result of the examination of the inventors of the present invention on formation of scales on the surface of the steel material, shapes of the interfaces between the scales and the parent phase of the surface portion of the steel material, and influence of alloying elements on the formation of the internal oxidation layer, in view of interaction of Cu, Sn, Al, Ni, Si and Mn. Satisfying these formulas makes it possible to inhibit Cu embrittlement. The reasons why the above formulas (1) to (4) are specified will be described below.

$$K1=[Al]/(3[Si]+[Mn])\geq 0.050 \quad (1)$$

K1 is a value represented by the contents of Al, Si and Mn. K1 is a value that affects the formation of the internal oxidation layer. Al, Si and Mn are all elements baser than Fe. Al, Si and Mn are oxidized prior to Fe when the oxidation of the steel material is progressing, and generate large numbers of minute oxide particles on the surface portion of the steel material. It is the internal oxidation layer that is formed by the oxide particles of these elements.

Oxides generated in the internal oxidation layer are composite oxides composed of Al, Si, Mn and O. The composition of the composite oxides is roughly grouped into the Si—Mn system containing $SiO_2$ and MnO as the main components and $Al_2O_3$ of less than 10%, the Si—Al system containing $SiO_2$ and $Al_2O_3$ as the main components and MnO of less than 20%, the Al—Mn system containing $Al_2O_3$ and MnO as the main components and $SiO_2$ of less than 10%, and so on. It is preferable that the content of $Al_2O_3$, which is at the total amount in the composite oxides in the internal oxidation layer, is no less than 15% and no more than 40%.

In a case where commercial steel that has a relatively low Al content is kept at high temperature in the atmosphere, an internal oxidation layer is formed inside the parent phase of a steel material. This internal oxidation layer is such that: $SiO_2$ and MnO are contained as the main components; and the content of $Al_2O_3$ is less than 3% at best. On the other hand, in a case where the Al content is high, an internal oxidation layer partially containing $Al_2O_3$ is formed because a reducing power of Al is strong.

In a case where the value of K1 is less than 0.050, the main oxides in the internal oxidation layer is SiMn oxides. Inside the Cu liquid phase, which is separated partially, oxygen does not diffuse enough and does not react with Si or Mn. Thus, the internal oxidation layer does not grow there, and is not uniform in thickness. As a result, oxidation on grain boundaries of the steel material (grain boundary oxidation) remarkably progresses, and it becomes easy that the separated Cu liquid phase permeates the grain boundaries, to bring about Cu embrittlement.

On the other hand, in a case where the value of K1 is 0.050 or more, $Al_2O_3$ is easy to be formed relatively to the case where the value is less than 0.050, the internal oxidation layer grows inside the separated Cu liquid phase, and the internal oxidation layer uniform in thickness is formed. As a result, Cu embrittlement is inhibited.

The value of K1 is preferably no more than 2.0. If the value of K1 is more than 2.0, $Al_2O_3$ is excessively formed inside the internal oxidation layer. Specifically, oxides of each element that composes the steel material grow along the grain boundaries of the steel material, which actually encourages oxidation of the steel material, and it becomes easy that the separated Cu liquid phase permeates the grain boundaries, to bring about Cu embrittlement.

$$K2=[Ni]/([Cu]+5[Sn])\geq 0.10 \quad (2)$$

K2 is a value represented by the contents of Ni, Cu and Sn. K2 is a value that affects selective oxidation behavior of Fe when oxidation of the steel material progresses.

In a case where the value of K2 is less than 0.10, the Cu liquid phase is easy to be formed and separated. Moreover, the shapes of the interfaces between scales and the parent phase of the surface portion of the steel material are not roughened, but are smooth. Thus, the Cu liquid phase separated on the interfaces is accumulated, and the cracking susceptibility of the steel material is increased.

The value of K2 is preferably 1.2 or less. This is because K2 of a too large value stops an effect from being increased any more, which is not economically preferable.

$$K3=[Al]/[Ni]\geq 0.20 \quad (3)$$

K3 is the ratio of the contents of Al and Ni. K3 is a value that affects the uniformity of the formed internal oxidation layer in thickness.

In a case where the value of K3 is less than 0.20, the FeNi alloy phase formed on the surface portion of the steel material inhibits oxidation of its inside. As a result, the internal oxidation layer is not uniform in thickness. When the internal oxidation layer is not uniform in thickness, the growth of oxides of each element that composes the steel material along the grain boundaries of the steel material is promoted, and it becomes easy that the separated Cu liquid phase permeates the grain boundaries. Thus, Cu embrittlement is brought about.

The value of K3 is preferably no more than 2.0. If the value of K3 is more than 2.0, $Al_2O_3$ is excessively formed inside the internal oxidation layer. Specifically, oxides of each element that composes the steel material grow along the grain boundaries of the steel material, oxidation of the steel material is encouraged, and it becomes easy that the separated Cu liquid phase permeates the grain boundaries, which brings about Cu embrittlement.

(4) Content of $Al_2O_3$ in Composite Oxides that are Generated in Internal Oxidation Layer: 15 to 40%

The content of $Al_2O_3$ in composite oxides that are generated in the internal oxidation layer is preferably 15 to 40%. In a case where the content of $Al_2O_3$ in composite oxides is less than 15%, ununiformity occurs to the internal oxidation layer in thickness. This is because: while internal oxidation is progressing along with oxidation of the surface portion (growth of scales), Ni is partially concentrated to form a FeNi alloy phase; internal oxidation hardly progresses in this FeNi alloy phase, and as a result, the internal oxidation layer is not uniform in thickness. In the area where internal oxidation does not progress, only grain boundary oxidation remarkably progresses as oxidation in crystal grains is inhibited, which becomes starting points of cracking. The Cu liquid phase is easy to permeate the grain boundaries where remarkable grain boundary oxidation progresses, to bring about Cu embrittlement. On the other hand, if $Al_2O_3$ is generated in the FeNi alloy phase as well, the internal oxidation layer is uniform in thickness. As a result, Cu embrittlement is inhibited. The content of $Al_2O_3$ in composite oxides at this time is no less than 15%.

In contrast, if an amount of Al increases, the content of $Al_2O_3$ in composite oxides increases. If the content of $Al_2O_3$ is 40% or more by mass, it causes occurrence of faults in hot working because of the hardness. Therefore, it is preferable that the content of $Al_2O_3$ in composite oxides that are generated in the internal oxidation layer is 40% or less.

The content of $Al_2O_3$ in composite oxides that are generated in the internal oxidation layer can be obtained by, for example, passing the following 1) to 7) in order:

1) A specimen is taken out of the steel material, and its surface portion (vertical section) is observed with a scanning electron microscope (SEM).

2) Compositional differences are observed on a backscattered electron image, and an oxide is selected. Here, on the backscattered electron image, the heavier an element is, the stronger its brightness is. Since elements forming oxides, O, Al, Si and Mn are all lighter than Fe, the oxides are observed as having weaker brightness than the Fe parent phase, and are possible to be distinguished.

3) Composition of the oxide is evaluated with an energy dispersive X-ray spectrometer (EDS). At this time, the composition is evaluated by means of an atomic ratio (atomic concentration) concerning the area of the oxide.

4) From the constituent elements of the composition according to the atomic concentration, the ratio of the atomic concentration of each metallic element, which is except light elements C and O, and the main component of the parent phase, Fe, is obtained (the ratios of Al, Si and Mn as the main constituent elements of the composite oxide is obtained).

5) In view of a valence in forming the oxide, the obtained ratios are converted into the constituent oxides. Molecular weights of $Al_2O_3$, $SiO_2$ and MnO ($Al_2O_3$ ($AlO_{1.5}$): 50.98, $SiO_2$: 60.10 and MnO: 70.94) and the obtained ratios of the constituent oxides are converted into weight concentrations of the constituent oxides.

6) The content of $Al_2O_3$ in the composite oxide is calculated.

7) Above 1) to 6) are carried out on at least ten composite inclusions, and a mean value is obtained.

$$1.0 \leq [Cu]/[Sn] \leq 8.0 \quad (5)$$

[Cu]/[Sn] is the ratio of the contents of Cu and Sn, that is, the above described Cu/Sn ratio. The Cu/Sn ratio of 1.0 to 8.0 makes it possible to get enough corrosion resistance under a severe environment such as a chloride environment and an oxidizing environment.

In a case where [Cu]/[Sn] is less than 1.0, the steel is Sn-rich, and the ability of corrosion resistance of the Cu—Sn coexisting steel, which is an object, cannot be obtained. On the other hand, in a case where [Cu]/[Sn] exceeds 8.0, the steel is Cu-rich, so-called, steel containing Cu, and the ability of corrosion resistance of the Cu—Sn coexisting steel, which is an object, cannot be obtained. In view of the above, the Cu/Sn ratio shall be 1.0 to 8.0 in the present invention.

3. Method for Manufacturing Cu—Sn Coexisting Steel in Present Invention

The method for manufacturing Cu—Sn coexisting steel in the present invention is a method including, when a slab is continuously cast using molten steel of the above described composition, adjusting the composition of the molten steel so as to satisfy the conditions represented by the above formulas (1) to (3), oxidizing the surface of the slab in a process of cooling the slab to form an internal oxidation layer, and generating $Al_2O_3$ in composite oxides that are generated in this internal oxidation layer. Whereby, a slab of a good quality can be manufactured wherein surface cracking and surface defects accompanied by Cu embrittlement are inhibited from occurring.

FIG. 1 is a flowchart to explain a method for manufacturing the Cu—Sn coexisting steel S1 according to one embodiment of the present invention (hereinafter may be referred to as "manufacturing method S1"). As depicted in FIG. 1, the manufacturing method S1 includes a step of adjusting the composition of the molten steel S11 (hereinafter may be abbreviated to "S11") and a step of forming the internal oxidation layer S12 (hereinafter may be abbreviated to "S12") in the order as described above. The step of adjusting the composition of the molten steel S11 is a step of, when a slab is continuously cast using the molten steel of the above described composition, adjusting the composition of the molten steel so as to satisfy the conditions represented by the above formulas (1) to (3). The adjustment of the composition of the molten steel in S11 is carried out by addition of an alloy in a refining stage. The step of forming the internal oxidation layer S12 is a step of forming the internal oxidation layer by oxidizing the surface of the slab that is obtained by cooling the molten steel, whose composition is adjusted in S11, in the process of cooling the slab. In the manufacturing method S1, $Al_2O_3$ is contained by composite oxides that are generated in the internal oxidation layer formed in S12. In the manufacturing method S1, it is preferable that the content of $Al_2O_3$ in the composite oxides that are generated in the internal oxidation layer formed in S12 is 15 to 40% by mass.

Figure 2:
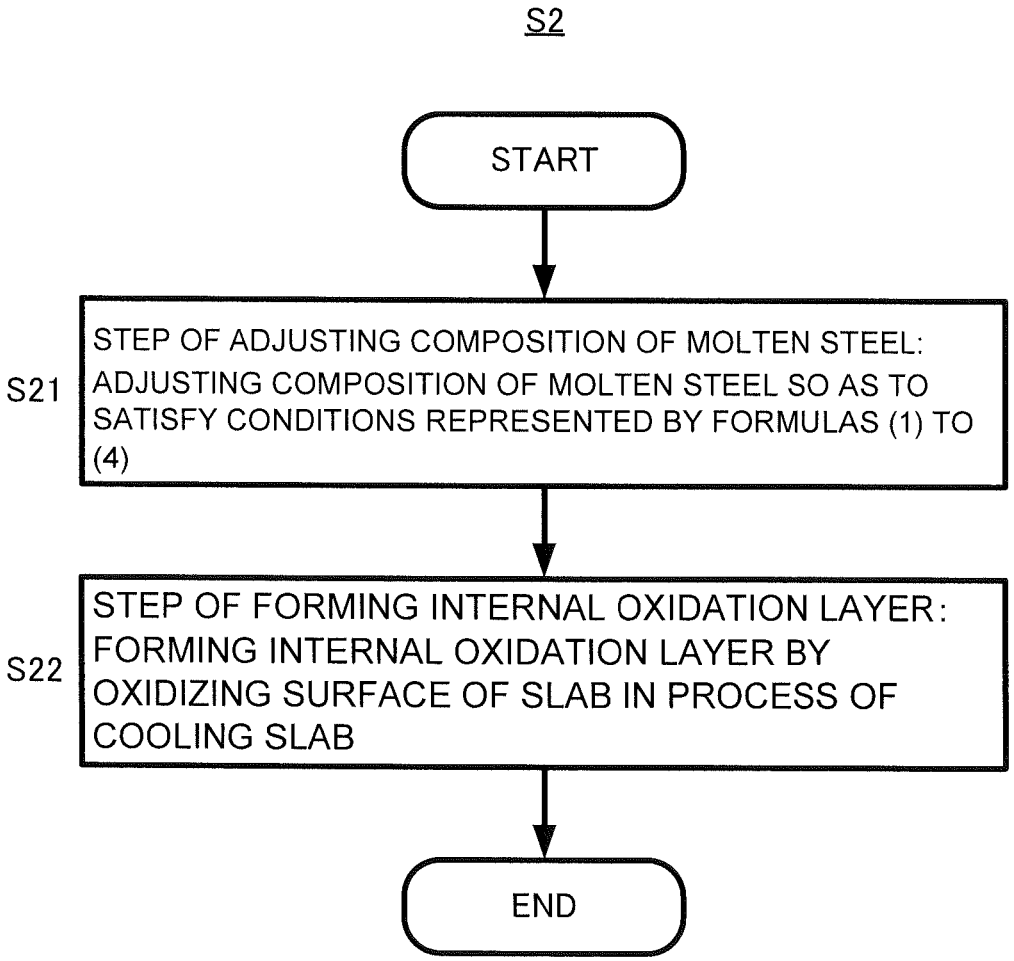
FIG. 2 is a flowchart to explain another embodiment of the method for manufacturing Cu—Sn coexisting steel according to one embodiment of the present invention.

In the method for manufacturing Cu—Sn coexisting steel of the present invention, the step of adjusting the composition of the molten steel is preferably a step of adjusting the composition of the molten steel so as to satisfy the conditions represented by the above formulas (1) to (3), and the condition represented by the above formula (4). FIG. 2 represents a flowchart to explain a method for manufacturing the Cu—Sn coexisting steel S2 according to this embodiment (hereinafter may be referred to as "manufacturing method S2"). As depicted in FIG. 2, the manufacturing method S2 includes a step of adjusting the composition of the molten steel S21 (hereinafter may be abbreviated to "S21") and a step of forming the internal oxidation layer S22 (hereinafter may be abbreviated to "S22") in the order as described above. The step of adjusting the composition of the molten steel S21 is a step of, when a slab is continuously cast using the molten steel of the above described composition, adjusting the composition of the molten steel so as to satisfy the conditions represented by the above formulas (1) to (4). The adjustment of the composition of the molten steel in S21 is carried out by addition of an alloy in a refining stage. The step of forming the internal oxidation layer S22 is a step of forming the internal oxidation layer by oxidizing the surface of the slab that is obtained by cooling the molten steel, whose composition is adjusted in S21, in the process of cooling the slab. In the manufacturing method S2, $Al_2O_3$ is contained by composite oxides that are generated in the internal oxidation layer formed in S22. In the manufacturing method S2, it is preferable that the content of $Al_2O_3$ in the composite oxides that are generated in the internal oxidation layer formed in S22 is 15 to 40% by mass.

According to this method, slabs of a good quality where surface cracking and surface defects accompanied by Cu embrittlement are inhibited from occurring can be manufactured. In addition, slabs manufactured by this method have no surface cracking or surface defects, and surface cracking does not occur thereto even in hot-rolling that is a post process. Thus, a steel material of a good surface quality can be manufactured by means of the Cu—Sn coexisting steel of the present invention as a material.

Cu embrittlement in heating and cooling can be also inhibited on an ingot that is manufactured by pouring, into a mold having a bottom, the molten steel satisfying the above described compositions and either formulas (1) to (3) or formulas (1) to (4), by carrying out blooming thereon, forming an internal oxidation layer through oxidation of the surface of a slab in a process of cooling the ingot after heating for hot-rolling, and generating $Al_2O_3$ in composite oxides that are generated in this internal oxidation layer.

4. Cu—Sn Coexisting Steel of Present Invention

Figure 3:
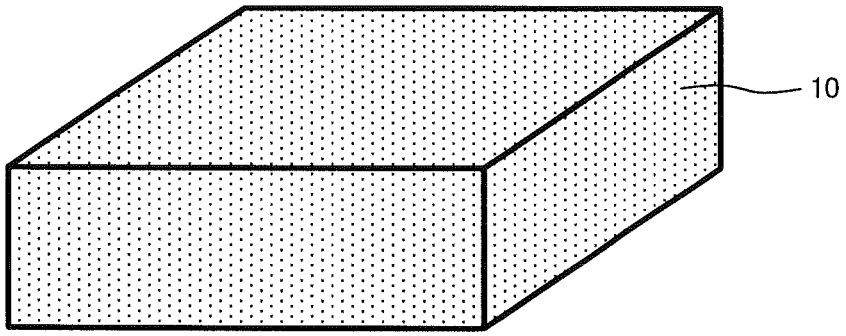
FIG. 3 is a view to explain the Cu—Sn coexisting steel according to one embodiment of the present invention.

FIG. 3 is a view to explain Cu—Sn coexisting steel 10 according to one embodiment of the present invention. The Cu—Sn coexisting steel 10 depicted in FIG. 3 is a slab manufactured by the above described manufacturing method S1. According to the manufacturing method S1, slabs of a good quality (Cu—Sn coexisting steel 10) where surface cracking and surface defects accompanied by Cu embrittlement are inhibited from occurring can be manufactured. Thus, the Cu—Sn coexisting steel 10 is a steel material of a good quality where surface cracking and surface defects accompanied by Cu embrittlement are inhibited from occurring. While FIG. 3 depicts the slab manufactured by the manufacturing method S1, the Cu—Sn coexisting steel of the present invention can be manufactured by the manufacturing method S2. According to the manufacturing method S2, slabs of a good quality where surface cracking and surface defects accompanied by Cu embrittlement are inhibited from occurring can be also manufactured.

Examples

The following preliminary and final tests were done in order to confirm the effects of the method for manufacturing Cu—Sn coexisting steel of the present invention, and results thereof were evaluated.

1. Preliminary Test 1-1. Method of Test

Cu—Sn coexisting steels each having the composition of Nos. 1 to 22 represented in Table 1 were manufactured by melting in a vacuum melting furnace, to obtain ingots of 50 kg each. In this table, the content of Al represents the content of acid soluble Al. The obtained ingots were each forged, and these forged parts were heated and rolled, to obtain specimens of steel materials. The surface of each specimen was oxidized by being kept in an electric furnace having an atmosphere at 1100° C. for 15 minutes, to generate scales, and each specimen was cooled to room temperature.

TABLE 1

| | | Composition (% by Mass) | | | | | | | | | | | | |
|---|---|---|---|---|---|---|---|---|---|---|---|---|---|---|
| No. | Class. | C | Si | Mn | P | S | Cu | Sn | Ni | Al* | Cu/Sn | K1 | K2 | K3 |
| 1 | Ref. Ex. | 0.04 | 0.26 | 1.51 | 0.009 | 0.002 | 0.36 | 0.10 | 0.32 | 0.14 | 3.60 | 0.06 | 0.37 | 0.44 |
| 2 | Ref. Ex. | 0.18 | 0.35 | 1.35 | 0.021 | 0.001 | 0.28 | 0.16 | 0.24 | 0.12 | 1.75 | 0.05 | 0.22 | 0.50 |
| 3 | Ref. Ex. | 0.09 | 0.30 | 1.05 | 0.015 | 0.001 | 1.50 | 0.19 | 0.28 | 0.12 | 7.89 | 0.06 | 0.11 | 0.43 |
| 4 | Ref. Ex. | 0.13 | 0.20 | 0.58 | 0.011 | 0.002 | 0.50 | 0.20 | 0.30 | 0.06 | 2.50 | 0.05 | 0.20 | 0.20 |
| 5 | Ref. Ex. | 0.13 | 0.20 | 0.58 | 0.011 | 0.002 | 0.50 | 0.20 | 0.30 | 0.06 | 2.50 | 0.05 | 0.20 | 0.20 |
| 6 | Ref. Ex. | 0.13 | 0.20 | 0.58 | 0.011 | 0.002 | 0.50 | 0.20 | 0.30 | 0.06 | 2.50 | 0.05 | 0.20 | 0.20 |
| 7 | Ref. Ex. | 0.09 | 0.25 | 0.95 | 0.011 | 0.002 | 0.48 | 0.06 | 0.18 | 0.18 | 8.00 | 0.11 | 0.23 | 1.00 |
| 8 | Ref. Ex. | 0.13 | 0.25 | 0.95 | 0.011 | 0.002 | 0.30 | 0.30 | 0.25 | 0.50 | 1.00 | 0.29 | 0.14 | 2.00 |
| 9 | Ref. Ex. | 0.12 | 0.25 | 0.95 | 0.011 | 0.002 | 0.45 | 0.15 | 0.15 | 0.10 | 3.00 | 0.06 | 0.13 | 0.67 |
| 10 | Ref. Ex. | 0.12 | 0.25 | 0.95 | 0.011 | 0.002 | 0.20 | 0.08 | 0.06 | 0.12 | 2.50 | 0.07 | 0.10 | 2.00 |
| 11 | Ref. Ex. | 0.20 | 0.31 | 1.00 | 0.011 | 0.002 | 0.40 | 0.18 | 1.00 | 0.25 | 2.22 | 0.13 | 0.77 | 0.25 |
| 12 | Ref. Ex. | 0.12 | 0.25 | 0.95 | 0.011 | 0.002 | 0.20 | 0.06 | 0.80 | 0.18 | 3.33 | 0.11 | 1.60 | 0.23 |
| 13 | Comp. Ex. | 0.12 | 0.31 | 1.00 | 0.011 | 0.002 | 0.40 | 0.18 | 0.32 | 0.05 | 2.22 | 0.03 | 0.25 | 0.16 |
| 14 | Comp. Ex. | 0.12 | 0.28 | 0.72 | 0.011 | 0.002 | 0.50 | 0.12 | 0.10 | 0.08 | 4.17 | 0.05 | 0.09 | 0.80 |
| 15 | Comp. Ex. | 0.12 | 0.25 | 0.95 | 0.011 | 0.002 | 0.45 | 0.15 | 0.05 | 0.10 | 3.00 | 0.06 | 0.04 | 2.00 |
| 16 | Comp. Ex. | 0.12 | 0.25 | 0.95 | 0.011 | 0.002 | 0.50 | 0.10 | 0.50 | 0.04 | 5.00 | 0.02 | 0.50 | 0.08 |
| 17 | Comp. Ex. | 0.12 | 0.25 | 0.95 | 0.011 | 0.002 | 0.60 | 0.20 | 0.60 | 1.05 | 3.00 | 0.62 | 0.38 | 1.75 |
| 18 | Comp. Ex. | 0.12 | 0.15 | 0.55 | 0.011 | 0.002 | 0.40 | 0.10 | 0.25 | 0.05 | 4.00 | 0.05 | 0.28 | 0.20 |
| 19 | Comp. Ex. | 0.12 | 0.26 | 0.98 | 0.011 | 0.002 | 0.20 | 0.06 | 0.04 | 0.11 | 3.33 | 0.06 | 0.08 | 2.75 |
| 20 | Comp. Ex. | 0.12 | 0.25 | 0.95 | 0.011 | 0.002 | 0.50 | 0.20 | 1.10 | 0.25 | 2.50 | 0.15 | 0.73 | 0.23 |
| 21 | Comp. Ex. | 0.12 | 0.30 | 0.95 | 0.011 | 0.002 | 0.35 | 0.10 | 0.24 | 0.06 | 3.50 | 0.03 | 0.28 | 0.25 |
| 22 | Comp. Ex. | 0.12 | 0.25 | 0.95 | 0.011 | 0.002 | 0.35 | 0.10 | 0.65 | 0.12 | 3.50 | 0.07 | 0.76 | 0.18 |

*Al represents the content of acid soluble Al.

Nos. 1 to 12 represent reference examples in each of which composition and values of K1 to K3 satisfied the specification of the present invention. Nos. 13 to 16 represent comparative examples in each of which at least one value of K1 to K3 did not satisfy the specification of the present invention, and No. 17 represents a comparative example where composition did not satisfy the specification of the present invention. Nos. 18 and 20 represent comparative examples in each of which composition did not satisfy the specification of the present invention, No. 19 represents a comparative example where composition and the value of K2 did not satisfy the specification of the present invention, No. 21 represents a comparative example where the value of K1 did not satisfy the specification of the present invention, and No. 22 represents a comparative example where the value of K3 did not satisfy the specification of the present invention.

1-2. Method of Evaluation

Each specimen was evaluated from its cracking susceptibility. The evaluation of the cracking susceptibility was carried out by means of structure observation of a section of the surface portion of each specimen after cooling, with an optical microscope, and structure observation and elementary analysis with a SEM/EDS.

Observed with an optical microscope were scales, internal oxidation layers, the parent phases of the specimen and forms and colors of deposits. With a SEM/EDS, forms and composition of the deposits were observed and analyzed. In the temperature range where selective oxidation was progressing, a liquid phase whose main composition was Cu (Cu liquid phase) was generated.

It was determined that in a case where the observed form of deposits was a membranous accumulation between the interfaces of scales and the parent phase of the surface portion of a specimen, and was linear spread on the grain boundaries of the specimen, there was a strong possibility that these deposits were in a liquid phase. In a case where, as a result of composition analysis of deposits, the main components of the deposits were Cu and Sn, whose melting points were lower than Fe, that is, in a case where the content of Cu or Sn was high and thus, the deposits were possible to be considered as a fusible alloy phase of Cu or Sn actually, the deposits were determined to be separated as a liquid phase.

Evaluation items were the following a to d:

a. A state of separation of the Cu liquid phase on the surface portion of a specimen. This was because if the Cu liquid phase was separated, embrittlement was easy to occur to a steel material. A liquid phase has the characteristic of accumulating like a membrane once separated. Thus, it was possible to be determined whether to be liquid phase separation or solid phase separation according to the separation form. In a case where the separation form was granular and each granule was so minute as to be less than 1 μm, it was possible to be determined that a Cu solid phase was not separated, that is, liquid membrane embrittlement did not occur. Thus, if the separation was membranous, it was determined that the cracking susceptibility was large.

b. A state of progress of roughening the shapes of interfaces between scales and the parent phase of the surface portion of a specimen. This was because: if the shapes of interfaces were smooth, the separated Cu liquid phase was accumulated, which made embrittlement easy to occur; in contrast, if roughening of the shapes of interfaces progressed, the separated Cu liquid phase did not accumulate on the interfaces but was taken into scales, and thus, removal of the liquid phase was promoted; therefore, Cu embrittlement was inhibited. If the forms of boundaries of scales and the parent phase were largely roughening forms, embrittlement was difficult to occur. In contrast, if the boundaries were flat, the Cu liquid phase easily accumulated like a membrane. When the boundaries between scales and the parent phase were roughened by 50 μm or over in height, the separated Cu liquid phase did not accumulate on the interfaces but was taken into scales. So no embrittlement occurred. Thus, it was determined that if the boundaries between scales and a parent phase were roughened by less than 50 μm in height, the cracking susceptibility was large.

c. A state of uniformity of an internal oxidation layer in thickness. This was because if an internal oxidation layer was not uniform in thickness, the separated Cu liquid phase was concentrated on grain boundaries of a part of a specimen where the internal oxidation layer was thin, and embrittlement was easy to occur. It was determined that if an internal oxidation layer was not uniform in thickness (difference between the maximum and the minimum of the thickness was 30 μm or more), the cracking susceptibility was large.

d. Whether or not the separated Cu liquid phase penetrated grain boundaries of a prior γ (austenite) phase (grain boundaries at 1100° C. Hereinafter referred to as "prior γ grain boundaries") of the surface portion of a specimen. This was because penetration of the Cu liquid phase was evidence of embrittlement of a steel material. If a Cu phase penetrated prior γ grain boundaries, this was a Cu liquid phase, which was evidence of liquid membrane embrittlement. Thus, it was determined that if a Cu phase penetrated surface γ grain boundaries, the cracking susceptibility was large.

1-3. Evaluation Results

The evaluation of the above a to d was combined, and the cracking susceptibility was evaluated. Table 2 represents the proportion of $Al_2O_3$ in composite oxides generated in an internal oxidation layer in addition to evaluation of items of a to d and evaluation of the cracking susceptibility as the combined evaluation. In Table 2, in a case where the boundaries between scales and the parent phase of the surface portion of a specimen were roughened by 50 μm or more in height, it was determined to be "Roughened", and in a case where there was no such roughening, it was determined to be "Smooth". "Thickness of Internal Oxidation Layer" was determined to be "Uniform" in a case where difference between the maximum and minimum of the thickness was less than 30 μm, and it was determined to be "Not Uniform" in a case where the difference was 30 μm or more. "Proportion of $Al_2O_3$ in Oxides Contained in Internal Oxidation Layer" is represented by ○ if the proportion was no less than 15% and no more than 40%, and represented by x if the proportion was less than 15% or beyond 40%. It is noted that concerning the steel material of No. 8 represented in Table 1, the $Al_2O_3$ content in composite oxides contained in the internal oxidation layer was 29.3% as the mean value obtained by composition analysis on randomly selected 10 composite oxides with an EDS.

TABLE 2

| No. | Class. | Separation of Cu Liquid Phase | Penetration of Cu Liquid Phase into Grain Boundaries | State of Interfaces | Thickness of Internal Oxidation Layer | Proportion of $Al_2O_3$ in Oxides Contained in Internal Oxidation Layer | Cracking Susceptibility |
|---|---|---|---|---|---|---|---|
| 1 | Ref. Ex. | Partially | No | Roughened | Uniform | ○ | Low |
| 2 | Ref. Ex. | Partially | No | Roughened | Uniform | ○ | Low |
| 3 | Ref. Ex. | Partially | No | Roughened | Uniform | ○ | Low |
| 4 | Ref. Ex. | Partially | No | Roughened | Uniform | ○ | Low |
| 5 | Ref. Ex. | Partially | No | Roughened | Uniform | ○ | Low |
| 6 | Ref. Ex. | Partially | No | Roughened | Uniform | ○ | Low |
| 7 | Ref. Ex. | Partially | No | Roughened | Uniform | ○ | Low |
| 8 | Ref. Ex. | Partially | No | Roughened | Uniform | ○ | Low |
| 9 | Ref. Ex. | Partially | No | Roughened | Uniform | ○ | Low |
| 10 | Ref. Ex. | Partially | No | Roughened | Uniform | ○ | Low |
| 11 | Ref. Ex. | None | No | Roughened | Uniform | ○ | Low |
| 12 | Ref. Ex. | None | No | Roughened | Uniform | ○ | Low |
| 13 | Comp. Ex. | Partially | Yes | Roughened | Not Uniform | x | High |
| 14 | Comp. Ex. | Partially | Yes | Smooth | Not Uniform | ○ | High |
| 15 | Comp. Ex. | All | Yes | Smooth | Not Uniform | ○ | High |
| 16 | Comp. Ex. | Partially | Yes | Roughened | Not Uniform | x | High |
| 17 | Comp. Ex. | Partially | Yes | Roughened | Uniform | x | High |
| 18 | Comp. Ex. | Partially | Yes | Roughened | Not Uniform | ○ | High |
| 19 | Comp. Ex. | All | Yes | Smooth | Not Uniform | ○ | High |
| 20 | Comp. Ex. | Partially | Yes | Roughened | Not Uniform | ○ | High |
| 21 | Comp. Ex. | Partially | Yes | Roughened | Not Uniform | x | High |
| 22 | Comp. Ex. | Partially | Yes | Roughened | Not Uniform | x | High |

As represented in Table 2, in each No. 1 to 10 among the reference examples, while the separation of a Cu liquid phase on the interfaces between scales and the parent phase of the surface portion of a specimen partially occurred, no separated Cu liquid phase penetrated prior γ grain boundaries of the surface portion of the specimen, and the cracking susceptibility was low. It was considered that this was because roughening of the interfaces of scales and the parent phase of the surface portion of the specimen progressed and removal of the separated Cu liquid phase effectively progressed, and because an internal oxidation layer of uniform thickness was generated inside scales and the separated Cu liquid phase was not concentrated on the prior γ grain boundaries of the specimen.

In each No. 11 and 12 among the reference examples, the separation of a Cu liquid phase on the interfaces between scales and the parent phase of the surface portion of a specimen never occurred, and the cracking susceptibility was low. It was considered that this was because a predetermined amount of $Al_2O_3$ was contained in composite oxides that were generated by internal oxidation since Al of 0.06% or more was contained and the condition of K1 was satisfied, and because generation of the Cu liquid phase was inhibited and roughening of the interfaces between scales and the parent phase progressed since Ni of 0.05% or more was contained and the condition of K2 was satisfied, and in addition, because an internal oxidation layer of uniform thickness was generated inside scales since the condition of K3 was satisfied.

In all the reference examples, composite oxides that were contained in an internal oxidation layer contained $Al_2O_3$ of no less than 5% and less than 90%. The total amount of $Al_2O_3$ that composite oxides contained (the content of $Al_2O_3$ in composite oxides) was no less than 15% and no more than 40%.

On the contrary, in each No. 13 to 17, which were comparative examples, the separation of a Cu liquid phase occurred on a part of or all the interfaces between scales and the parent phase of the surface portion of a specimen, and the separated Cu liquid phase penetrated the prior γ grain boundaries of the surface portion of a specimen. Thus, the cracking susceptibility was high. Open cracking also occurred to part of the prior γ grain boundaries. The proportion of $Al_2O_3$ in oxides contained in an internal oxidation layer was less than 15% or beyond 40% by mass.

In each No. 14 and 15 among the comparative examples, the interfaces between scales and the parent phase of the surface portion of a specimen were smooth, and an internal oxidation layer was not uniform in thickness. Thus, it was considered that the Cu liquid phase accumulated on the interfaces was concentrated to penetrate the prior γ grain boundaries.

In each No. 13 and 16 among the comparative examples, roughening of the interfaces between scales and the parent phase of the surface portion of a specimen progressed. An internal oxidation layer was not generated because the surface portion of a specimen was partially high-Ni alloyed, and thus an internal oxidation layer was not uniform in thickness. Oxidation of the prior γ grain boundaries far progressed and the Cu liquid phase accumulated on the interfaces penetrated around crystal grains of the surface portion, which was high-Ni alloyed.

In No. 17 among the comparative examples, roughening of the interfaces between scales and the parent phase of the surface portion of the specimen also progressed. Although the internal oxidation layer of uniform thickness was generated, excessive $Al_2O_3$ was separated on grain boundaries a lot, which encouraged penetration of the Cu liquid phase into the prior γ grain boundaries.

In No. 18 that represents a comparative example, the separation of a Cu liquid phase partially occurred to the interfaces between scales and the parent phase of the surface portion of the specimen, and the separated Cu liquid phase penetrated the prior γ grain boundaries of the surface portion of the specimen. Thus, the cracking susceptibility was high. In No. 18, roughening of the interfaces between scales and the parent phase of the surface portion of the specimen progressed. The internal oxidation layer was not generated because the surface portion of the specimen was partially high-Ni alloyed, and thus the internal oxidation layer was not uniform in thickness. Oxidation of the prior γ grain boundaries far progressed and the Cu liquid phase accumulated on the interfaces penetrated around crystal grains of the surface portion, which was high-Ni alloyed.

In No. 19 that represents a comparative example, the separation of a Cu liquid phase occurred on all the interfaces between scales and the parent phase of the surface portion of the specimen, and the separated Cu liquid phase penetrated the prior γ grain boundaries of the surface portion of the specimen. Thus, the cracking susceptibility was high. In No. 19, the interfaces between scales and the parent phase of the surface portion of the specimen were smooth. Thus, it was considered that the Cu liquid phase accumulated on the interfaces was concentrated to penetrate the prior γ grain boundaries.

In No. 20 that is a comparative example, roughening of the interfaces between scales and the parent phase of the surface portion of the specimen progressed. The surface portion of the steel material was FeNi alloyed, and the growth of the internal oxidation layer is partially inhibited, which made ununiformity occur to the thickness of the internal oxidation layer, and which encouraged oxidation of the grain boundaries. The separation of a Cu liquid phase partially occurred to the interfaces between scales and the parent phase of the surface portion of the specimen, and the separated Cu liquid phase penetrated the prior γ grain boundaries of the surface portion of the specimen.

In each No. 21 and 22 that represents a comparative example, the separation of a Cu liquid phase partially occurred to the interfaces between scales and the parent phase of the surface portion of a specimen, and the separated Cu liquid phase penetrated the prior γ grain boundaries of the surface portion of a specimen. Thus, the cracking susceptibility was high. The proportion of $Al_2O_3$ in oxides contained in an internal oxidation layer was less than 15% or beyond 40% by mass. In No. 21, the internal oxidation layer was not uniform in thickness. Oxides in this internal oxidation layer were mainly SiMn oxides. Oxidation of the grain boundaries remarkably progressed, and the separated Cu liquid phase penetrated the grain boundaries deeply to bring about embrittlement. In No. 22, the surface portion of the steel material was FeNi alloyed, and oxidation of its inside was partially inhibited. As a result, the internal oxidation layer was not uniform in thickness, and oxidation of the grain boundaries was encouraged. The separation of the Cu liquid phase partially occurred to the interfaces between scales and the parent phase of the surface portion of the specimen, and the separated Cu liquid phase penetrated the prior γ grain boundaries of the surface portion of the specimen.

2. Final Test

Next, in view of the results of the preliminary test, the final test with a continuous casting machine was done.

2-1. Method of Test

Cu—Sn coexisting steel having the composition of each No. 23 and 24 represented in Table 3 was manufactured by melting in a melting furnace. No. 23 represents an example of the present invention where the composition and values of K1 to K3 satisfied the specification of the present invention. No. 24 represents a comparative example where the values of K1 and K3 did not satisfy the specification of the present invention.

TABLE 3

| | | Composition (% by Mass) | | | | | | | | | | | | |
|---|---|---|---|---|---|---|---|---|---|---|---|---|---|---|
| No. | Class. | C | Si | Mn | P | S | Cu | Sn | Ni | Al* | Cu/Sn | K1 | K2 | K3 |
| 23 | Ex. of This Invention | 0.14 | 0.23 | 0.90 | 0.011 | 0.002 | 0.45 | 0.18 | 0.30 | 0.18 | 2.50 | 0.11 | 0.22 | 0.60 |
| 24 | Comp. Ex. | 0.14 | 0.25 | 0.95 | 0.011 | 0.002 | 0.44 | 0.19 | 0.25 | 0.03 | 2.32 | 0.02 | 0.18 | 0.12 |

*Al represents the content of acid soluble Al.

Continuous casting was carried out with a vertical continuous casting machine as such that: the manufactured molten steel by melting of 2.5 t was poured into a tundish via a ladle, and was supplied into a vibrating internal water cooled mold of a copperplate via a submerged nozzle with 50 to 70° C. of superheat at the casting speed of 0.8 m/min. The property values of used mold flux arranged on the molten steel in the mold were; solidification temperature: 1235° C.; viscosity at 1300° C.: 0.04 Pa·s; and basicity (value obtained from division of the content of CaO (% by mass) by the content of $SiO_2$ (% by mass)): 1.8.

Spray cooling was carried out downward the mold with a specific water flow of 1.7 L per 1 kg of a slab, to manufacture a slab of 100 mm in thickness, 800 mm in width and 3500 mm in length. The obtained slab was cooled to room temperature.

Part of the cooled slab was cut, to take a specimen for examining whether surface cracking existed on the slab or not, and a steel material for a hot-rolling test. The hot-rolling test was done as such that: the taken steel material was heated in the atmosphere to 1100° C., and after that, was rolled with the reduction of 75%.

2-2. Method of Evaluation

Evaluation items were whether surface cracking on a slab existed or not, and whether surface cracking on a steel material after rolled (hereinafter referred to as "rolled steel material") existed or not. Whether grain boundary cracking existed or not was examined on both cases of the surface cracking by dye check (dye penetrant inspection).

3. Evaluation Results

There was no surface cracking on both of the slab and rolled steel material of No. 23, which represented an example of the present invention. Cu embrittlement was inhibited.

In contrast, surface cracking was confirmed on both of the slab and rolled steel material of No. 24, which represented a comparative example. Occurrence of fin cracking was also confirmed at an end part of the rolled steel material.

The present invention is described concerning the embodiment that is, at the present, the most practical and preferable. The present invention is not limited to the embodiment disclosed in the description of the present application, but can be properly modified within the scope of the summary and idea of the invention readable from the claims and whole of the description. It must be understood that the Cu—Sn coexisting steel and the method for manufacturing the same accompanied by such modification are also encompassed in the technical scope of the present invention.

INDUSTRIAL APPLICABILITY

According to the method for manufacturing Cu—Sn coexisting steel of the present invention, slabs of a good quality where surface cracking and surface defects accompanied by Cu embrittlement are inhibited from occurring can be manufactured.

In addition, the Cu—Sn coexisting steel of the present invention has no surface cracking or surface defects, and surface cracking does not occur thereto even in hot-rolling that is a post process. Thus, a steel material of a good surface quality can be manufactured by means of the Cu—Sn coexisting steel of the present invention as a material.

REFERENCE SINGS LIST

S1, S2 . . . method for manufacturing Cu—Sn coexisting steel

S11, S21 . . . step of adjusting the composition of molten steel

S12, S22 . . . step of forming an internal oxidation layer

10 . . . Cu—Sn coexisting steel

The invention claimed is:

1. A method for manufacturing Cu—Sn coexisting steel by continuous casting of molten steel, the method comprising:

adjusting composition of molten steel so as to satisfy conditions represented by the following formulas (1) to (3), the molten steel containing, as chemical composition, C: 0.04 to 0.20%, Si: 0.05 to 1.00%, Mn: 0.20 to 2.50%, P: no more than 0.05%, S: no more than 0.02%, Cu: 0.20 to 1.50% and Sn: 0.06 to 0.50% and further containing Al: 0.06 to 0.25% and Ni: 0.05 to 1.00% by mass, and Fe and impurities as the remainder;

forming an internal oxidation layer by oxidizing a surface of a slab in a process of cooling the slab; and making composite oxides that are generated in the internal oxidation layer, contain $Al_2O_3$:

$$[Al]/(3[Si]+[Mn])\geq 0.050 \quad (1)$$

$$[Ni]/([Cu]+5[Sn])\geq 0.10 \quad (2)$$

$$[Al]/[Ni]\geq 0.20 \quad (3)$$

wherein [Al], [Si], [Mn], [Ni], [Cu] and [Sn] represent contents (% by mass) of Al, Si, Mn, Ni, Cu and Sn in the molten steel respectively.

2. The method for manufacturing Cu—Sn coexisting steel according to claim 1, wherein a content of $Al_2O_3$ in the composite oxides that are generated in the internal oxidation layer is 15 to 40% by mass.

3. The method for manufacturing Cu—Sn coexisting steel according to claim 1, wherein the composition of the molten steel is adjusted so as to further satisfy a condition represented by the following formula (4):

$$1.0\leq [Cu]/[Sn]\leq 8.0 \quad (4).$$

4. Cu—Sn coexisting steel that is manufactured by the method for manufacturing Cu—Sn coexisting steel according to claim 1.

5. The method for manufacturing Cu—Sn coexisting steel according to claim 2, wherein:

the composition of the molten steel is adjusted so as to further satisfy a condition represented by the following formula (4):

$$1.0\leq [Cu]/[Sn]\leq 8.0 \quad (4).$$

6. Cu—Sn coexisting steel that is manufactured by the method for manufacturing Cu—Sn coexisting steel according to claim 2.

7. Cu—Sn coexisting steel that is manufactured by the method for manufacturing Cu—Sn coexisting steel according to claim 3.

8. Cu—Sn coexisting steel that is manufactured by the method for manufacturing Cu—Sn coexisting steel according to claim 5.

9. A method for manufacturing Cu—Sn coexisting steel by continuous casting of molten steel, the method comprising:

adjusting composition of molten steel so as to satisfy conditions represented by the following formulas (1) to (3), the molten steel containing, as chemical composition, C: 0.04 to 0.20%, Si: 0.05 to 1.00%, Mn: 0.20 to 2.50%, P: no more than 0.05%, S: no more than 0.02%, Cu: 0.20 to 1.50% and Sn: 0.06 to 0.50% and further containing Al: 0.06 to 1.00% and Ni: 0.05 to 1.00% by mass, and Fe and impurities as the remainder;

forming an internal oxidation layer by oxidizing a surface of a slab in a process of cooling the slab; and making composite oxides that are generated in the internal oxidation layer, contain $Al_2O_3$:

$$[Al]/(3[Si]+[Mn])\geq 0.050 \quad (1)$$

$$[Ni]/([Cu]+5[Sn])\geq 0.10 \quad (2)$$

$$[Al]/[Ni]\geq 0.20 \quad (3)$$

wherein [Al], [Si], [Mn], [Ni], [Cu] and [Sn] represent contents (% by mass) of Al, Si, Mn, Ni, Cu and Sn in the molten steel respectively, wherein a content of $Al_2O_3$ in the composite oxides that are generated in the internal oxidation layer is 15 to 40% by mass.

10. The method for manufacturing Cu—Sn coexisting steel according to claim 9, wherein the composition of the molten steel is adjusted so as to further satisfy a condition represented by the following formula (4):

$$1.0\leq [Cu]/[Sn]\leq 8.0 \quad (4).$$

11. Cu—Sn coexisting steel that is manufactured by the method for manufacturing Cu—Sn coexisting steel according to claim 9.

12. Cu—Sn coexisting steel that is manufactured by the method for manufacturing Cu—Sn coexisting steel according to claim 10.

* * * * *